United States Patent [19]

Szware

[11] 4,378,549

[45] Mar. 29, 1983

[54] RESISTIVE ELECTRICAL COMPONENTS

[75] Inventor: Joseph Szware, Ramat Gan, Israel

[73] Assignee: Vishay Intertechnology, Inc., Malvern, Pa.

[21] Appl. No.: 185,756

[22] Filed: Sep. 10, 1980

Related U.S. Application Data

[60] Continuation of Ser. No. 968,988, Dec. 13, 1978, abandoned, which is a division of Ser. No. 814,291, Jul. 11, 1977, Pat. No. 4,172,249.

[51] Int. Cl.[3] ..... H01C 10/00

[52] U.S. Cl. ..... 338/195; 29/620; 338/308; 338/320

[58] Field of Search ..... 338/195, 308, 309, 320; 29/620; 427/101, 126

[56] References Cited

U.S. PATENT DOCUMENTS

| | | | |
|---|---|---|---|
| 3,056,937 | 10/1962 | Pritikin | 338/195 |
| 3,530,304 | 1/1976 | Keller et al. | 338/195 X |
| 3,916,142 | 10/1975 | Ennis | 338/195 |

*Primary Examiner*—C. L. Albritton

*Attorney, Agent, or Firm*—Weiser, Stapler & Spivak

[57] ABSTRACT

Improved resistive electrical components are disclosed comprising an insulating or insulated substrate, a resistive foil bonded to the substrate having photoetched therein a pair of terminal pads for making electrical connections to the component and a system of resistive paths interconnecting the terminal pads, said system including an unadjustable section or sections and a plurality of adjustable sections, each having an adjustment tab associated therewith, said tab being removable to modify said section resistance and thereby altering the total resistance presented by the component between its terminal pads, the configurations of the sections differing from each other in a modified geometric progression so that the total resistance of said component is altered by a differing amount depending on which of the sections is modified by removal of its associated adjustment tab, whereby the total resistance of the component may be systematically varied in a sequence of successive steps to achieve a desired ultimate value of the total resistance of the component to the desired degree of accuracy with the least number of steps, the most effective use of substrate surface area, the least contribution to reliability degradation, and the lowest cost. Adjustment of the total resistance of the component to its desired ultimate value and precision is assisted by monitoring the component resistance while making successive adjustments. Placement of said adjustment tabs along one edge of said substrate simplifies manual adjustment and makes practical the use of automatic apparatus controlled by a monitor.

7 Claims, 5 Drawing Figures

RESISTIVE ELECTRICAL COMPONENTS

This is a continuation of application Ser. No. 968,988, filed Dec. 13, 1978, abandoned, which is turn is a divisional application of Ser. No. 814,291 filed July 11, 1977, U.S. Pat. No. 4,172,249.

This invention relates to improvements in resistive electrical components. More particularly it relates to the construction details that permit production of a useful range of resistance values to a high degree of accuracy with a minimum of adjustment time.

It is known to construct resistive electrical components comprising an insulating cylinder having a conductive material deposited thereon between a pair of terminal pad portions, the magnitude of the resistance of such a component being determined by the resistivity of the material of which it is formed and the length and width of a pattern, having numerous convolutions that are developed in the resistive material at adjustment to achieve a desired value of the total resistance of the component to an accuracy within the capabilities of this adjustment method.

Also, to achieve more accurate adjustment, it is known as in the manner described in U.S. Pat. No. 3,405,381 granted Oct. 8, 1968, to Zandman et al to provide a foil of a resistive alloy cemented to a substrate, said foil and substrate having physical characteristics such that when cemented together the temperature coefficient of resistance of the component is close to zero. The pattern is composed of a system of gross and fine adjustment, the gross adjustment being facilitated by an arithmetic progression of significant resistance sections, each section being comprised of resistive lines in parallel connection to be changed to series connection at the time of adjustment by the removal of shorting bars and the fine adjustment facilitated by a series of digressively less sectional resistance contribution, thus permitting adjustment of the total resistance to final value with a very high order of accuracy.

The present invention is directed to an improved resistive component, also employing a flat substrate having resistance paths formed thereon between a pair of terminal pad portions, in which the resistive paths are so formed and configured as to make possible the systematic variation of the total resistance in a series of successive steps so that the ultimate value of total resistance of the component to a high order of accuracy may be arrived at but now with the minimum number of successive incremental adjustment operations through the use of a modified geometric progression of sectional resistance contribution.

Another object of the invention is to modify the geometric progression in such a way that resistive errors in the progressive due to manufacturing variations are permitted.

A further object of the invention is to modify the geometric progression in such a way that adjustment errors in incorrectly skipping one step are permitted.

Yet another object of the invention is to collect all the adjustment points along one edge of the pattern for ease of manual adjustment and facilitation of automatic adjustment.

Yet another object of the invention is to obtain a higher order of reliability through the minimizing of resistance adjustment steps and maximizing the use of available surface area with active resistance lines.

In accordance with the invention, the foregoing objects and other which will appear are achieved, in a resistive electrical component comprising an insulating substrate and a pair of conductive pads formed thereon for making electrical connections to the component by providing a system of resistive paths formed on said substrate and interconnecting said terminal pads, said system including a plurality of sections, each having an adjustment tab associated therewith, said tab being removable to modify the resistance in said section and thereby alter the total resistance presented by said component between said terminal pads, the configuration of said sections differing from each other in a modified geometric progression so that the total resistance of said component is altered by a different amount depending on which of said sections is modified by removal of its associated adjustment tab, whereby the total resistance of said component may be systematically varied in a series of successive steps to achieve a desired ultimate value of said total resistance to an ultimate accuracy by a minimum number of incremental adjustment operations. A range of resistance values is achieved in one common finished device size by employing various patterns differing only in the line widths and lengths in each section but always with the same number of sections and associated adjustment tabs.

In an idealized form of the invention, the geometric progression of adjustment contribution starts, for example, with a 16.384% addition to the total resistance in the most significant section and through fifteen additional sections, each being one-half of the previous, provides for a final adjustment to value with the least significant section contributing 0.0005%. Adjustment of all sections increases the total resistance by 32.7675% and adjustment to any intervening value to say ±0.001% is achievable by skipping sections that when added to previous sections already adjusted would cause an adjustment to a value above the desired value. For example, adjustment of a resistive component in accordance with the invention to a final value of 10,000 ohms from an initial value of 8,000 ohms is accomplished in accordance with the following sequence.

Step number 1 will increase the total resistance by 16.384% of 8,000 ohms and since this change, when added to 8,000 ohms, will bring the total value to something less than 10,000 ohms, the adjustment is made and the new value is now 9,310.72 ohms.

Step number 2 will increase the total resistance by 8.192% of 8,000 ohms which is one-half the previous step of 16.384%, and since this change when added to 9,310.72 ohms will bring the total value to something less than 10,000 ohms, the adjustment is made and the new value is now 9,966.08 ohms.

Steps number 3, 4, 5 and 6 will increase the total resistance by various amounts but since any of these changes, when added to 9,966.08 ohms, will bring the total value to something greater than 10,000 ohms, the adjustments 3, 4, 5 and 6 are skipped and the value remains 9,966.08 ohms.

Step number 7 will increase the total resistance by 0.256% of 8,000 ohms and since this change, when added to 9,966.08 ohms, will bring the total value to something less than 10,000 ohms, the adjustment is made and the new value is now 9,986.56 ohms, and so on in the process of selecting and skipping until the final total resistance of 10,000 ohms to the final precision is achieved.

The idealized form of the invention provides no margin of error in the value of each adjustment or in the performance of the operator in selecting the adjustments to be made.

In a preferred form of the invention, the geometric progression is modified from the ideal to allow for manufacturing error in the accuracy of each section and to permit an inadvertent skip. Starting with a 12.1% addition to the total resistance in the most significant section and through twenty additional sections, each being approximately 60% of the previous section, adjustment of all sections increases the total resistance by approximately 31.74% and adjustment to any intervening value to any accuracy down to say ±0.001% is achievable by adjusting and skipping appropriate sections as in the idealized form. With this modification of sectional value from 50% of the value of the preceding section in the idealized form to 60% of the value of the preceding section in this preferred form, small errors within a section or the false skipping of any section are corrected by the proper selection for adjustment and skipping in subsequent sections.

To cover resistance ranges for practical use from 1 ohm to 100,000 ohms for example whereby all said values could be produced on the same size substrate, one has to produce different photoetched patterns since every pattern is adjustable by for example 30% only. To cover the range from 1 ohm to 2 ohms, one would need about 3 patterns, the first one covering the range from 1 ohm to 1.3 ohms (a 30% adjustability), the second pattern from 1.3 ohms to 1.7 ohms (another approximately 30% adjustability), the third pattern from 1.7 ohms to over 2 ohms. From 2 ohms to 4 ohms, another 3 different patterns would have to be produced. From 4 ohms to 8 ohms, another 3 patterns. Hence, approximately 10 patterns per decade or about 50 patterns for the range of 1 ohms to 100,000 ohms. Obviously if the adjustability is 50% rather than 30%, then fewer patterns are required.

In another form of the invention, fewer sections are employed reducing the amount of adjustability available for the same end accuracy and thereby however increasing the number of different patterns necessary to cover the full range of resistance values, thereby reducing the number of adjustment steps.

In another form of the invention, more sections are employed increasing the number of adjustment steps but reducing the number of patterns necessary to cover the full range of resistance values.

In yet another form of the invention, the terminal pad portions may be plated with metals such as copper and gold to facilitate electrical connection.

Preferably, in accordance with the invention, the adjustment tab portions are positioned adjacent an edge of the substrate. For example, the substrate may be of rectangular configuration and the adjustment tabs may be positioned adjacent one edge thereof. If desired, the system of resistive paths may occupy more than one surface of the substrate. Also, if desired, the substrate may be made of metal having an insulating layer applied to one or more surfaces thereof, the conductive terminal pads and the system of resistive paths being cemented to said insulating layer, or the cement itself could serve as an insulator.

Preferably also, the individual sections are designed and constructed so as to provide for changes in the total resistance of the component by predetermined differing amounts such that, if a particular adjustment step is inadvertently omitted, its effect can be made up by subsequently making a plurality of adjustments of smaller magnitude.

Obviously, the same approach applies to resistor networks where many of the above described patterns can be interconnected on one or several substrates to form any desired network such as voltage dividers, ladder networks, etc.

The invention will be fully understood from consideration of the following detailed description with reference to the accompanying drawings in which.

Figure 3:
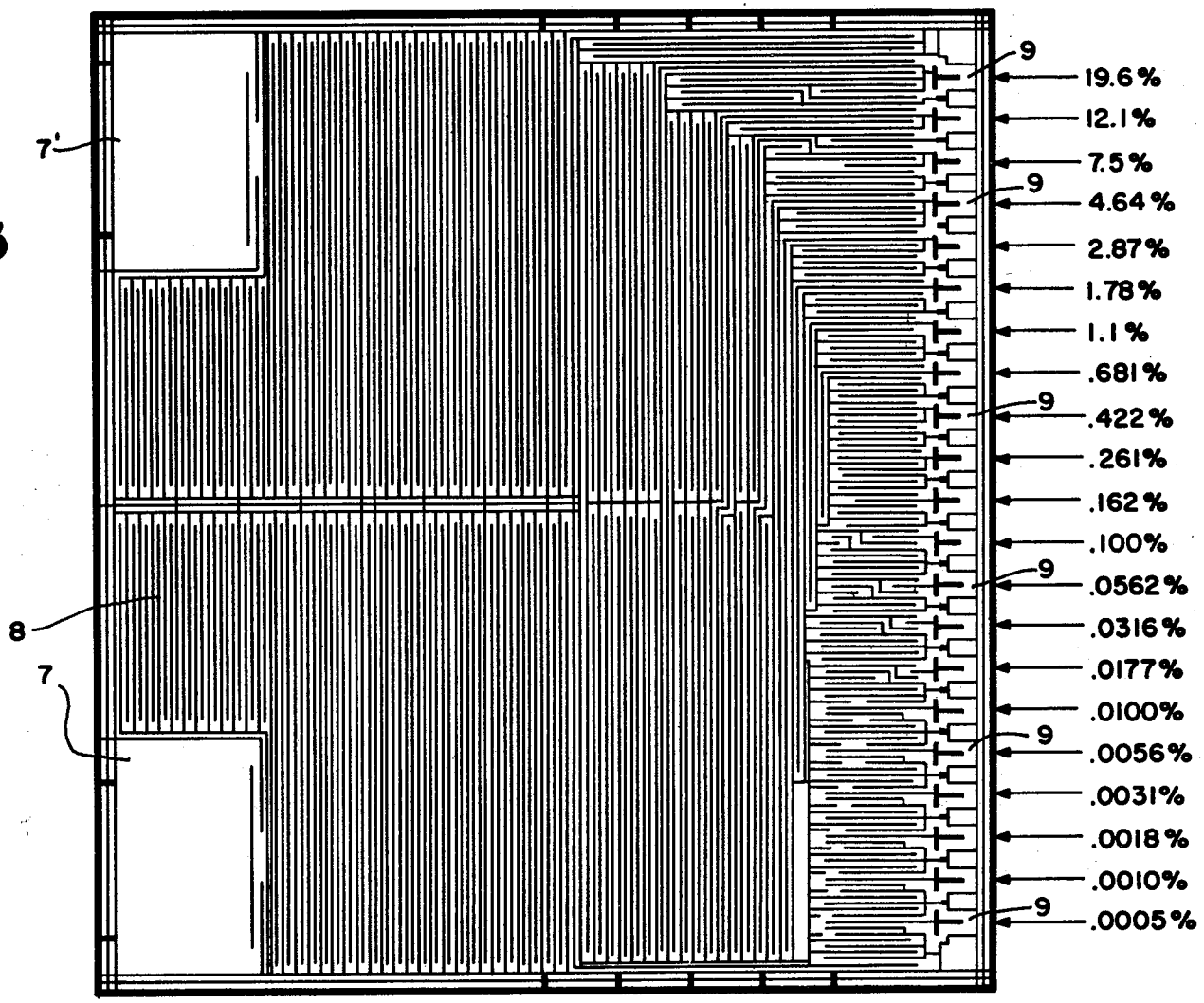
FIG. 3 illustrates the configuration of the photoetched pattern consisting of the terminal pad portions, the resistive paths, the unadjustable and adjustable resistive path sections and the associated adjustment tabs along one edge is a typical resistive electrical component in accordance with the invention.
Figure 3A:
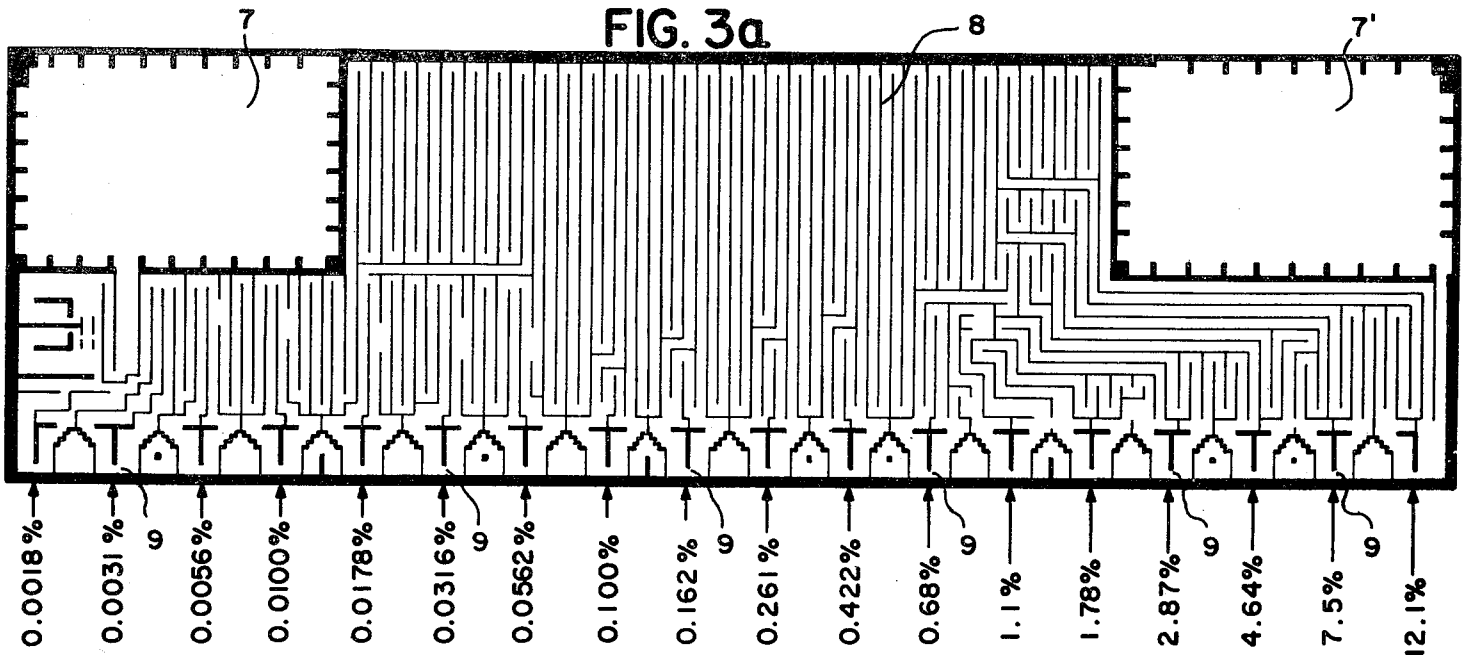
Figure 4:
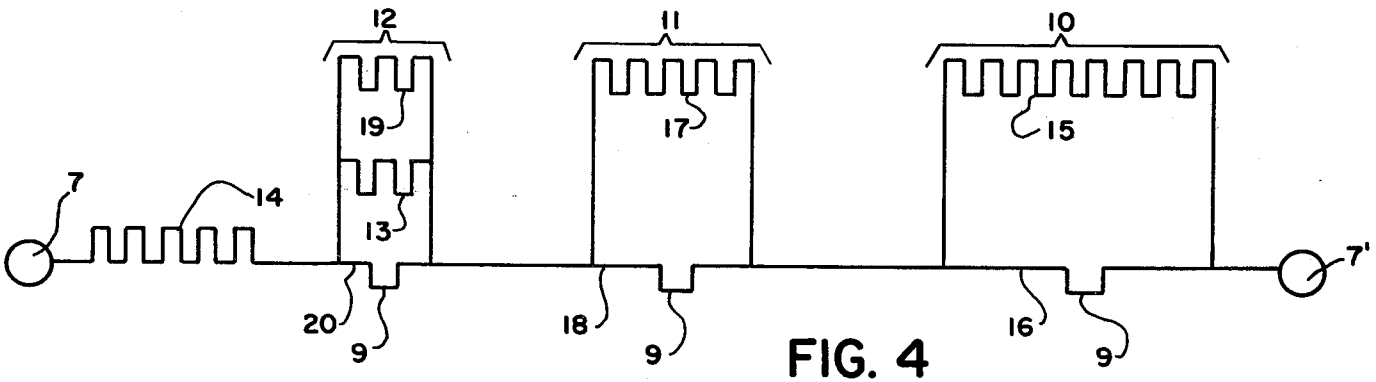

FIG. 3*a* illustrates yet another configuration of the pattern in accordance with the invention;

FIG. 4 is a schematic diagram to which reference will be made in explaining the principles of the invention.

The same reference numerals designate similar elements in the different figures.

Figure 1:
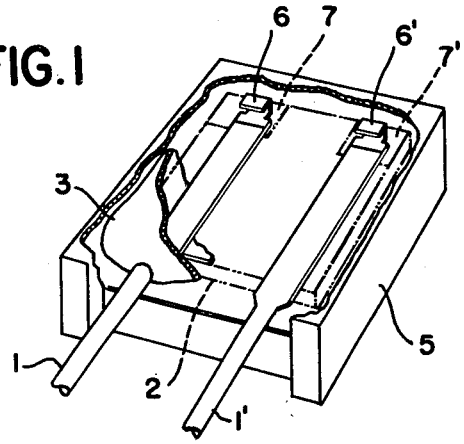
FIG. 1 is a perspective view showing the general construction of a resistive electrical component in accordance with the invention.

Referring to FIG. 1, there is shown a completed electrical component in accordance with the invention comprising external leads 1 and 1' with flattened and extended tabs 6 and 6' brought up and over substrate 2 to engage terminal pad portions 7 and 7'. A stress isolation coating of rubber 3 is applied to the entire surface of the subassembly of leads and substrate and the coated subassembly is molded or encapsulated into outer plastic housing 5.

Figure 2:
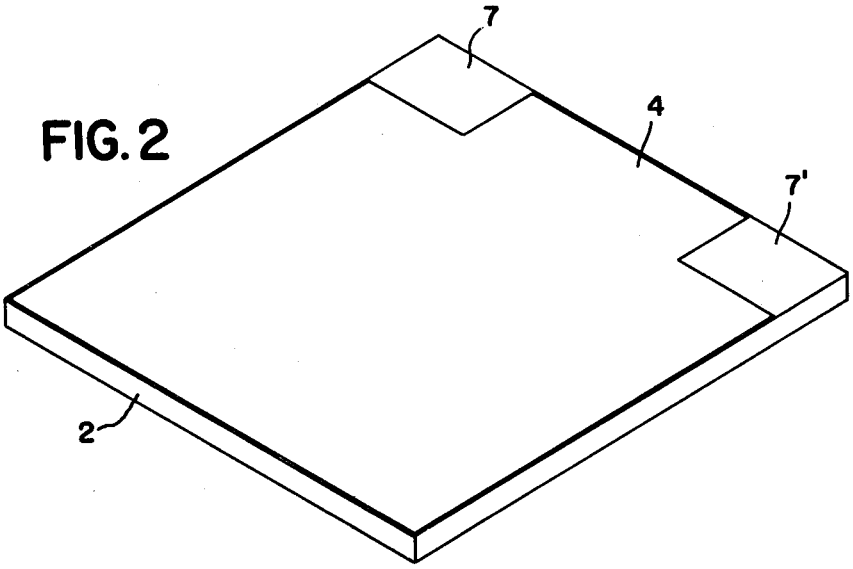
FIG. 2 is a perspective view showing the general construction of a typical resistive element in accordance with the invention.

Referring now to FIG. 2, there is shown a resistive element of the electrical component in accordance with the invention comprising a substrate 2 on the upper surface of which is cemented a nickel chromium alloy film layer 4 into which has been photoetched one of various available patterns depending on final desired resistance always consisting of terminal pad portions 7 and 7' and serially-connected between the terminal pad portions a series of resistive path sections.

Referring now to FIG. 3, there is shown a plan view of a typical resistance pattern comprising the terminal pads 7 and 7', the interconnecting resistive paths 8 and the adjustment tabs 9 which may be used in a resistive electrical component as described above with reference to FIG. 1 and FIG. 2 As will be seen from examining this figure, the resistive path 8 interconnecting the terminal pads 7 and 7', comprises a plurality of serially-connected sections, each of said sections comprising a resistive path provisionally shorted by the adjustment tab in some instances while in others one or more parallel paths are provisionally shorted by the adjustment tab. Also, a major section or sections having no provision for adjustment are serially-connected with the plurality of serially-connected adjustable sections. In each adjustable section there is provided an adjustment tab 9 positioned near the outer edge of the resistive pattern and having a constricted part immediately bordering on said outer edge which can readily be removed by scribing, sand blasting, laser beam evaporation, grinding or any of various known methods of material removal to interrupt the parallel connection of the adjustment tab of the series-connected section with which it is associated. Adjacent the outer edge of the pattern in FIG. 3 are numerals indicating the percentage change in the total resistance of the component measured between terminal pads 7 and 7′ which will be produced by cutting through the constricted part of the corresponding one of the adjustment tabs 9. It will be seen that these percentage changes are of decreasing magnitude proceeding from one end to the other. As can be demonstrated, such magnitudes differ by unequal amounts in accordance with a modified geometric progression. As will readily be seen, given the total resistance of the component measured between terminal pads 7 and 7′ prior to adjustment, and knowing the ultimate value of resistance desired for the component, such desired resistance being between the resistance measured prior to adjustment and the maximum value attainable by removal of all adjustment tabs, such value can be achieved to a high order of precision by successively removing parts of appropriately selected adjustment tabs 9 beginning with one of relatively large magnitude but less than the total amount of change to be effected in the resistance of the component, and then continuing with successively smaller values but always less than the total amount of remaining change to be effected in the resistance of the component, until the desired ultimate component resistance is achieved to the desired degree of precision. As hereinbefore stated, this may be accomplished by monitoring the component resistance and then making the necessary adjustments either manually or by means of automatic apparatus controlled by a monitor.

As will be apparent, a resistive component in accordance with the invention may be constructed to provide a selection of patterns, with the value of total resistance between its terminal pads prior to the adjustment operations being a function of the total length of the resistive paths interconnecting said terminal pads, the widths and thicknesses thereof, and the resistivity of the material of which they are formed. Similarly the total amount by which the component resistance can be varied during the adjustment process will depend on the configuration and construction of the individual serially-connected sections. Thus, should the desired ultimate value be above the adjustment capability of one pattern, then another pattern of appropriately higher initial resistance must be selected and if the desired ultimate resistance is below the initial resistance value of one pattern, then another pattern of appropriately lower initial resistance must be selected. In a preferred embodiment of the invention some overlapping of pattern values is provided by provisioning the useful range of resistance values with a selection of patterns differing in resistance in about 30% increments.

Further in accordance with the invention, in the pattern according to FIG. 3, the incremental changes in total resistance provided for are such that if, in making the successive adjustments to achieve the desired total resistance value of the component, a given adjustment step is inadvertently omitted, such omission can be corrected by making several successive subsequent adjustments of lesser magnitude, and the ultimate desired value of component resistance still can be achieved with the same high degree of precision within 0.0005 percent or other as predetermined by the pattern design. Assume, for example, that, at a particular point in the adjustment process, monitoring of the resistance of the component indicates that the next adjustment step should be taken and that a maximum of 0.100 percent increase in resistance is indicated, but that this adjustment step inadvertently was omitted. Then it still would be possible to make up this missed change in component resistance by making four smaller adjustments of 0.0562 percent, 0.0316 percent, 0.0100 percent and 0.0018 percent to produce a total change of 0.0996 percent—i.e., within 0.0004 percent of 0.100 percent—so as to permit achievement of the desired ultimate component resistance value with a precision of 0.0005 percent.

From examination of FIG. 3 it will be seen that the resistive paths are in a tortuous pattern and such that they comprise a plurality of serially-interconnected linear segments, each segment being disposed closely adjacent a preceding and/or a succeeding segment serially-connected therewith. This arrangement is particularly advantageous because it tends to minimize both the self-inductance and the inherent capacitance of the component. Self-inductance is minimized because the currents in adjacent segments flow in opposite directions, and therefore the electromotive forces which they induce in each other tend to cancel. Similarly, the inherent capacitance of the component is minimized because it is equal to the reciprocal of the sum of the reciprocals of the inherent capacitances between adjacent segments. Hence, resistive components constructed in the manner described herein are superior to conventional wire wound resistors comprising a continuous winding in one direction, whose self-inductance and capacitance are inherently high. Moreover, in the construction described, the resistive paths are distributed over a relatively large area on the surface of the insulating substrate which affords better dissipation of heat generated therein.

Referring now to FIG. 3*a* it will be seen that the principles of the invention are applicable to rectangular as well as square surfaces or other flat forms.

Reference now is made to the schematic circuit diagram of FIG. 4 to explain more fully the principles of operation of the invention. There are represented a plurality of three sections 10, 11 and 12 serially-connected to the unadjustable resistance 14 and thence between terminals 7 and 7′ corresponding to the terminal pad portions of the component illustrated in FIGS. 1, 2 and 3. Section 10 is shown as comprising a resistive portion 15 having connected in parallel therewith a portion 16 including serially an adjustment tab represented by the block 9. Section 11 likewise comprises a somewhat smaller resistive element 17 having a portion 18 connected in parallel therewith and also including serially an adjustment tab 9. Section 12 comprises a resistive element 19 having connected in parallel therewith a resistance element 13 and also in parallel therewith a portion 20 serially-connected with an adjustment tab portion 9. It will be seen that so long as the adjustment tab 9 in section 10 is intact, section 10 will present a relatively low resistance in the series connection between terminals 7 and 7′. When adjustment tab 9 in section 10 is removed, the resistance presented by section 10 will be increased substantially and will be equal to the resistance of element 15. Similarly in section 11, so long as adjustment tab 9 is intact the resistance of the section will be relatively low, but when adjustment tab 9 associated with this section is removed, the resistance of the section will be increased to be equal to the resistance of portion 17 which will be substantially less than that of the element 15 in section 10. In section 12, so long as adjustment tab 9 is intact the resistance presented by this section will be equal to the parallel combination of the resistances of portions 19, 13 and 20. However, when the connection through adjustment tab 9 is broken, the resistance provided by the section will be equal to the parallel combination of the portions 19 and 13 alone and therefore greater than that previously presented, but less than that of either element 15 or 17. Obviously the schematic diagram of FIG. 4 is only illustrative of the general principles of operation of a component constructed in accordance with the invention and does not purport to portray an actual embodiment of the invention or to illustrate all of the various possible configurations of the conductive paths in such an embodiment which will be better appreciated from a careful examination of the pattern of FIG. 3.

After their resistances have been adjusted to the desired value, components in accordance with the invention may be provided with one or more protective coatings as described, for example, in co-pending U.S. patent application Ser. No. 742,030 of Leon Resnicow for Attachment of Leads to Electrical Components. First, if desired to improve the peel strength of the etched pattern, there may be applied one or several coats of an epoxy or other resin, which coating may be of the order of 0.0002" to 0.002" in thickness. Following this, and over the coating it is highly desirable to apply a thicker mechanically protective layer of material such as a silicone rubber or other soft material which may be of the order of 0.010" in thickness and which provides a pliable cushioning layer for the component, which protects it from mechanical strains resulting from molding, shrinkage and the like. Also, if desired, following the application of the aforementioned protective coatings, the component may be encapsulated by molding with any of the well-known compounds commonly used in encapsulating electronic devices such as epoxy molding compounds, diallylphthalate compounds or silicone molding compounds to provide additional protection. The component may also be protected with a plastic compound enclosed in a plastic or ceramic case, or in a hermetic metal case with glass bead headers for bringing the connecting leads out through the case.

While the invention has been described with reference to certain preferred embodiments and modifications thereof, it will be apparent that numerous other modifications may be made, as will be apparent to those skilled in the art, within the scope of the invention as defined by the claims which follow.

I claim:

1. In a resistive electrical component which includes an insulating substrate, and a foil of resistive material upon the substrate, the foil having formed therein terminal pads, a resistive path connected between the terminal pads, and plurality of resistance adjustment tabs, each tab being connected to shunt a different portion of the resistive path and each tab being removable to break the shunt provided thereby, the improvement wherein each and every portion of the resistive path which is shunted by an adjustment tab has a different value of resistance, and these resistance values of the shunted portions of the resistive path differ in accordance with a progression which is modified from a geometric progression in such a way that a predetermined final resistance value of the component can be approximated to a desired tolerance through removal of a minimum number of the adjustment tabs in a systematic series of successive steps adding progressively smaller resistance values.

2. A method of trimming a resistive electrical component, to approximate a predetermined final resistance value, the component including a substrate, and a foil of resistive material cemented upon the substrate, the foil having formed therein terminal pads, a resistive path connected between the terminal pads, and a plurality of resistance adjustment tabs each connected to shunt a different portion of the resistive path and each removable to break the shunt provided thereby, at least one resistive path portion being not shunted by an adjustment tab, and the resistive path portions which are shunted by adjustment tabs having values of resistance which differ in accordance with substantially a geometric progression, the method comprising:

successively removing adjustment tabs which shunt resistive path portions having progressively smaller resistance values, and stopping the removing when the total resistance of the component is within a desired tolerance from the predetermined final value.

3. The method of claim 2 further comprising measuring the total component resistance at least between successive removals of adjustment tabs, and controlling the removal or non-removal of an additional tab in response to the measurement.

4. The method of claim 3 wherein each removal is of that tab which shunts the largest increment of resistance available without exceeding the desired tolerance above the predetermined final value.

5. The component of claim 1, in which the progression is such that each shunted portion has a resistance value which is about 60% of the shunted portion with the next higher resistance value.

6. The method of claim 2 wherein each successive adjustment tab is removed only if the resultant total resistance value is still below the predetermined final value after such removal.

7. The method of claim 6 wherein each successive adjustment tab removed is that which shunts the highest resistance portion which, after such removal, will still leave the resultant total resistance value below the predetermined final value.

* * * * *